US005598381A

United States Patent [19]

Bornand et al.

[11] Patent Number: 5,598,381

[45] Date of Patent: Jan. 28, 1997

[54] METHOD FOR TAKING DIRECTIONS AND TIMEPIECE INTENDED TO MAKE USE OF THIS METHOD

[75] Inventors: Etienne Bornand, Boudry; Rudolf Dinger, Saint-Aubin, both of Switzerland

[73] Assignee: ASULAB S.A., Bienne, Switzerland

[21] Appl. No.: 355,338

[22] Filed: Dec. 12, 1994

[30] Foreign Application Priority Data

Dec. 23, 1993 [CH] Switzerland ..... 3860/93

[51] Int. Cl.[6] ..... G04C 11/02; G04G 9/00

[52] U.S. Cl. ..... 368/10; 368/21

[58] Field of Search ..... 368/47, 10, 15–19, 368/21–27

[56] References Cited

U.S. PATENT DOCUMENTS 4,136,397 1/1979 Pierce ..... 368/15

5,068,838 11/1991 Klausner et al. ..... 368/47

FOREIGN PATENT DOCUMENTS 0042360 12/1981 European Pat. Off. .

448018 9/1991 European Pat. Off. .

2681159 9/1993 France .

*Primary Examiner*—Bernard Roskoski

*Attorney, Agent, or Firm*—Sughrue, Mion, Zinn, Macpeak & Seas

[57] ABSTRACT

According to this method the longitude of the place where one is situated on the surface of the earth is determined by comparing the local time with the time of a reference time zone, and the latitude of the place where one is situated is determined by measuring the inclination of the earth's magnetic field in relation to the horizontal.

1 Claim, 1 Drawing Sheet

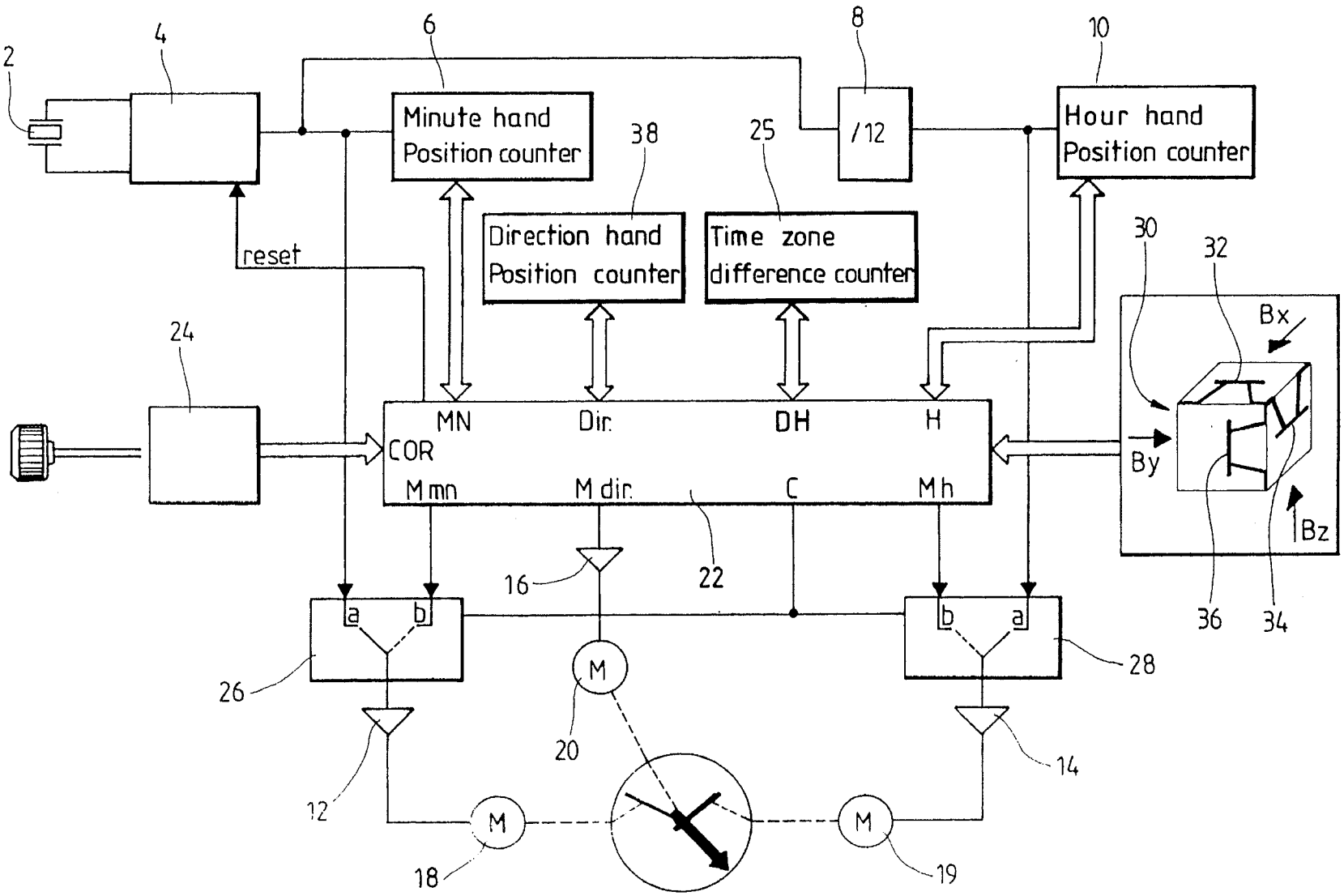
Hour hand Position counter
10
/12
8
Time zone difference counter
25
Direction hand Position counter
38
Minute hand Position counter
6
reset
4
2
24
Bx
By
Bz
30
32
34
36
H
DH
Dir.
MN
COR
Mh
C
M dir.
Mmn
22
28
a
b
14
16
12
26
M
19
20
18

METHOD FOR TAKING DIRECTIONS AND TIMEPIECE INTENDED TO MAKE USE OF THIS METHOD

BACKGROUND OF THE INVENTION

The present invention concerns a method for determining, at least approximately, the latitude and longitude of the place where one is situated on the earth's surface. The present invention also concerns a timepiece including a time base, at least hour and minute display intended to indicate local time, means for setting the time of said display means and in addition, including means for displaying data which is a function at least of the position of the timepiece on the earth's surface.

The most common methods for determining the latitude and longitude of the place where one is situated on the earth's surface rely upon an astronomical operation or even a decoding of the signals emitted by satellites. Such methods are ill suited to an entirely automatic use in a timepiece.

SUMMARY OF THE INVENTION

An aim of the present invention is thus to provide a method for determining at least approximately the latitude and longitude of the place where one is situated on the earth's surface, which is suitable for an entirely automatic use and which does not require recourse to satellites.

A second aim of the present invention is to provide a method for determining at least approximately the latitude and longitude of the place where one is situated on the earth's surface, which can be used in a device of small dimensions such as a timepiece.

A third aim of the invention is to provide a timepiece capable of automatically displaying data which depends upon the latitude and longitude of the place where one is situated.

The invention thus concerns, on the one hand, a method for determining at least approximately the latitude and longitude of the place where one is situated on the earth's surface, characterised in that it includes the following steps:

- determining the value of the time difference between the local time and the time of a reference time zone;
- converting said time difference value into an approximate value of the local longitude;
- determining the inclination of the magnetic field of the earth in relation to the horizontal;
- converting said inclination of the earth's magnetic field into an approximate value of the local latitude.

The determination of the time difference may be achieved simply, for example, by comparing the data provided by two timekeepers, and the inclination of the earth's magnetic field may be determined from the relationship between its vertical component and its horizontal component, both of which being able to be obtained with the aid of magnetic sensors.

According to an advantageous alternative embodiment of the method according to the invention, account is taken of the longitude at the time of converting the inclination of the earth's magnetic field into a latitude.

As the inclination of the earth's magnetic field in relation to the horizontal is a function not only of latitude, but also, to a certain extent, of longitude, a much more precise value of the latitude is obtained if account is taken of the longitude at the stage of converting the inclination of the earth's magnetic field into a latitude.

The present invention also concerns, on the other hand, a timepiece including a time base, at least hour and minute display intended to indicate the local time, means for setting the time of said display means and in addition, including means for displaying data which is a function of the place where the timepiece is situated on the earth's surface, characterised in that it includes measuring, calculating and conversion means, provided to put into operation the steps of the method of the present invention so as to determine said place where the timepiece is situated.

According to a particular embodiment of the present invention, said calculating means are also provided to determine, from said latitude and said longitude, the azimuth of a preselected place on the earth's surface.

According to an advantageous alternative of the latter embodiment, said measuring means are provided to determine, in addition, the direction of magnetic north, said calculating and data display means being provided to determine, as a function of said azimuth and said magnetic north direction, the direction of said preselected place and to indicate this direction.

BRIEF DESCRIPTION OF THE DRAWINGS

Other characteristics and advantages of the invention will appear upon reading the following description, which given solely by way of example and is made with reference to the attached drawing, which is a schematical block drawing describing the operation of a particular embodiment of the timepiece of the present invention.

DESCRIPTION OF PREFERRED EMBODIMENTS

The timepiece which will now be described is intended to put into use the method according to the invention and to use the value of the latitude and the value of the longitude thereby obtained to determine the direction of Mecca.

The timepiece of the present example is shown in the form of a block diagram. This timepiece comprises in series a quartz oscillator 2, a division chain 4 supplying a signal at 1/60 Hz (1 cycle/minute) and a minute hand position counter 6. It also comprises a divider-by-twelve 8, receiving the output signal from division chain 4, and an hour hand position counter 10, whose input is connected to the output of divider 8. Counters 6 and 10 are counters-by-sixty which define in standard mode the position of the minute and hour hands in relation to the hour-circle of the timepiece dial.

The timepiece is provided, in the embodiment shown, with three motors 18, 19 and 20 controlled respectively by driving circuits 12, 14 and 16 to drive respectively the minute hand, the hour hand and an additional hand, called the direction hand, intended to indicate the direction of Mecca. The two first driving circuits 14, 16 receive, in standard mode, the pulses applied respectively to the inputs of minute hand position counter 6 and hour hand position counter 10.

The elements of the block diagram which have just been described explain the operation of this timepiece as regards the standard time display. However, as already stated, the timepiece described here may also indicate the position of Mecca. The elements of the drawing which will be described below enable, on the one hand, the direction of Mecca to be determined and indicated, and on the other hand, the hour hand and minute hand to be reset to time.

As can be seen in the drawing, the timepiece also includes electronic control means 22 to enable, on the one hand, the method of the present invention to be put into operation, and on the other hand, the movement of one or other of the three hands to be driven when this is required. Electronic control means 22 comprise inputs MN and H to read the contents of minute and hour hand position counters 6 and 10, and a parallel access COR for the control signals produced by the movements of a time setting stem.

The signals provided to access COR of electronic control means 22 are produced by a circuit 24 for interpreting the position and movement of the control stem. These time setting signals enable the control of a correction of the display means either minute by minute or by an hour at a time, each of these corrections being able to be carried out in either direction. The operation of the control stem and of interpreting circuit 24 will not be described in detail here as a man skilled in the art already knows devices of this type. Patent No. EP-O 175 961 in particular, discloses a control stem used with an interpreting circuit easily able to be adapted for use with the timepiece described here.

One can also see in the diagram a time difference counter 25, connected to an input/output access DH of electronic control means 22. Counter 25 is a counter-by-twenty four which is intended to count the time zone changes corresponding to the correcting operations of an hour at a time carried out by the user with the aid of the control stem.

Electronic control means 22 also comprise three outputs Mmn, Mh and Mdir to supply the pulses to motors 18, 19 and 20 and an output C to control the state of two switches 26, 28 placed at the input of the two first driving circuits 12, 14 and arranged to transmit to them either the pulses applied at the inputs of the minute and hour hand position counters 6 and 10 when the switches are in a position referenced a, or the pulses supplied by electronic control means 22 when the switches are in a second position referenced b.

The electronic control means may be advantageously made in the form of an integrated circuit comprising a programmed micro-controller. A man skilled in the art will know, from the indications provided here, how to carry out the programming of the micro-controller, so as to enable it to carry out the operations described here.

In standard time display mode, the electronic control means are inactive, switches 26 and 28 are in the position referenced a and motors 18, 19 receive the pulses applied to the inputs of the minute and hour hand position counters 6 and 10.

Time Setting, Determination of Time Difference and Longitude

The elements which have just been described enable, on the one hand, the time displayed by the hands to be corrected and on the other hand, to keep a count of the time difference in relation to a reference time zone to enable the subsequent determination of the longitude in conformity with the method of the present invention. The user activates the time correcting operation by pulling out the stem. The outward movement of the stem causes interpreting circuit 24 to emit a signal to access COR of electronic control means 22. The receipt of this signal by electronic control means 22 drives switches 26 and 28 into state b. Simultaneously, electronic control means 22 emit a signal along a standby line (designated by the reset indication in the diagram) for division chain 4 so that it no longer provides the incrementation signal of minute and hour hand position counters 6 and 10.

Interpreting circuit 24 then sends pulses corresponding to the different manipulations of the stem by the user, to input COR of electronic control means 22 which, in turn, emit control pulses to increment or decrement minute and hour hand position counters 6 and 10 and to control simultaneously motors 18 and 19 to move the hands either in the conventional manner, minute by minute, or optionally by an hour at a time. When, at the end of the time setting operation, the stem is pushed back in, interpreting circuit 24 provides a deactivating signal to electronic control means 22 which in turn provide a signal via their output C to cause switches 26 and 28 to pass into state a. Simultaneously, the signal on the division chain standby line reverts to zero and the latter again begins providing the incrementation signal of hand position counters 6 and 10.

The user only uses the above-mentioned option of correcting the display by an hour at a time in the case where, during a journey, he changes time zone. In the latter case, when in accordance with the above description electronic control means 22 emit control pulses to increment or decrement hour hand position counter 10, they also emit control pulses to increment or decrement time difference counter 25. Time difference counter 25 thus permanently contains the value of the time difference between the place where the user of the watch is situated and a reference time zone.

The legal time of certain countries lies half way between two time zones. The time difference between these countries and their neighbours is thus half an hour. According to an advantageous alternative of the present invention, the latter is provided to take into account these peculiarities in political geography. To this end, a man skilled in the art will know, without any problem, how to replace time difference counter 25 with a modulo counter 48 and to modify simultaneously control stem movement interpreting circuit 24 so that the corrections to the display made at the time of changing time zones are made by half hour instead of by an hour at time.

The programming of the reference time zone is achieved by bringing the hour hand and minute hand into a position corresponding to the time of the time zone selected as the reference time zone, then by pushing on the crown for ten seconds. The pressure exerted on the crown by the user translates into a signal provided to electronic control means 22. When the electronic control means have detected this signal at their input COR for three seconds, they cause the contents of time difference counter 25 to be reset to zero, which has the effect of giving the time zone corresponding to the time displayed the role of reference time zone.

As the time zones cut the earth's surface into twenty four areas each having an angular width of substantially 15°, the contents of time difference counter 25 corresponds to an approximate indication of the longitude of the place where the timepiece wearer is situated. These contents may thus constitute the time difference data which are necessary to enable electronic control means 22 to implement the method of the present invention.

Determination of the Orientation of the Earth's Magnetic Field and the Latitude Referring again to the attached block diagram, it can be seen that the timepiece also includes a module (referenced 30) formed essentially of three unidirectional magnetic sensors 32, 34 and 36 placed perpendicularly in relation to each other and thus provided to measure the intensity of an external magnetic field according to three orthogonal directions. Numerous types of magnetic sensors are already known, and the particular type of sensor used for the invention is of no importance provided that the sensors are sufficiently sensitive to measure the earth's magnetic field, are of sufficiently small dimensions to be installed in a timepiece and finally that their electrical consumption is not excessive. These conditions are fulfilled, for example, by sensors of the fluxgate type.

Two of the sensors (referenced 32 and 34) are oriented in relation to the timepiece in such a way as to measure the intensity of the earth's magnetic field along two axes parallel to the plane of the timepiece dial (not shown). One of these two sensors (referenced 34) is oriented along an axis parallel to the diameter of the dial which passes through 6 and 12 o'clock, while the other sensor 32 is placed parallel to the diameter of the dial passing through 3 and 9 o'clock. Finally, the third sensor 36 of the timepiece is oriented perpendicularly to the dial. In this manner, when the timepiece is placed flat, that is to say with the dial plane horizontal, sensors 32 and 34 measure the two horizontal components of the earth's magnetic field Bx and By, and the third sensor 36 measures the vertical component Bz of the same field. The three measured intensities Bx, By and Bz are transmitted in a conventional manner by a bus to electronic control means 22. Means 22 are programmed so as to calculate, from the measured values Bx, By and Bz of the three components of the earth's magnetic field, the inclination I of this field in relation to the horizontal.

Inclination I of the earth's magnetic field varies according to the place where one is situated on the earth's surface. For a given longitude, it is in theory an unequivocal function of the latitude. In these conditions, if one knows the longitude of the place where one is situated as well as the inclination of the earth's magnetic field at this place, it is in theory possible to determine in an unequivocal manner the latitude of this place. To this end, electronic control means 22 comprise a non volatile memory in which a double input conversion table containing the values of inclination I of the earth's magnetic field has been programmed as a function of time zone and latitude. The access to this table enables electronic control means 22 to determine the value of the latitude of the place where the user is situated, as a function of the time zone such as it is provided by time difference counter 25, and of the inclination of the earth's magnetic field determined with the aid of sensors 32, 34 and 36. In order for this determination to be possible, it is of course necessary that electronic control means 22 have the use of a non volatile memory sufficiently large to store a sufficient number of the earth's magnetic field inclination values to cover the earth's surface with sufficient density. A set of 2000 points distributed more or less uniformly over the earth's surface is sufficient to obtain an acceptable level of accuracy.

It is also possible to limit the number of points necessary for the conversion table by using a non uniform point distribution, the points being, for example, more dense in populated areas than over oceans.

Determination of the Direction of Magnetic North and Mecca

As already stated, the timepiece described here is provided to indicate the direction of Mecca. To this end the co-ordinates (latitude and longitude) of Mecca have previously been programmed into a second non volatile memory of electronic control means 22. Thus, once the latitude and longitude of the place where the timepiece is situated on the earth's surface have been determined in conformity with the description given above, electronic control means 22 can calculate the azimuth corresponding to the direction of Mecca. This latter calculation only involves well known trigonometric relations. Further, the devices provided to carry out the latter calculation have already been disclosed, for example in patent No. DE-A-3412777.

Once the azimuth of Mecca has been determined, it is sufficient to know the direction of the north to be able to indicate the direction of Mecca. To this end, electronic control means 22 are also provided to determine the direction of the magnetic north from components Bx and By of the earth's magnetic field measured by the two horizontal sensors 32 and 34 already described above. As component By of the magnetic field is the component parallel to the direction of the diameter 12 o'clock—6 o'clock of the timepiece dial, the relationship between the two intensities Bx and By provides by a simple trigonometric operation the angle which the magnetic north makes with the axis 12 o'clock—6 o'clock of the timepiece dial.

Electronic control means 22 then carries out the sum of the previously calculated azimuth for Mecca and the angle between the magnetic north and the 12 o'clock—6 o'clock diameter of the timepiece. This sum corresponds to the angle between the direction of Mecca and the axis 12 o'clock—6 o'clock of the timepiece.

As it will have already been noted, the sum described here only really corresponds to the angle between the direction of Mecca and the axis 12 o'clock—6 o'clock of the watch to the extent that it is admitted that the direction of the magnetic north determined by sensors 32, 34 is identical to the actual geographical north direction. This is not, as is well known, generally the case. The declination of the magnetic field (angle between magnetic north and geographical north) which we have neglected may constitute a source of error in the determination of the direction of Mecca. It is possible to eliminate this source of error by providing in the non volatile microprocessor memory a second double entry table containing the declination of the earth's magnetic field for a set of points on the earth's surface indicated by their time zone and their latitude.

According to an advantageous alternative of the present invention, the method for determining the azimuth of Mecca may be simplified. In order to do this end, the non volatile timepiece memory comprises only one double entry table providing directly calculated values once and for all of the real azimuth of Mecca, as a function of the time zone and the inclination of the earth's magnetic field.

Indication of the Direction of Mecca

As has already been stated, the timepiece comprises a third motor 20 controlled by a driving circuit 16 and intended to drive the direction hand so that it indicates the direction of Mecca. As can be seen in FIG. 1, the timepiece comprises in addition a position counter 38 of the direction hand. This counter 38 is a counter-by-360 which defines the position of the direction hand in relation to the 360 degrees of the timepiece hour circle.

In order for the direction hand to indicate the direction of Mecca, electronic control means 22 first of all read the contents of direction hand position counter 38, and subtract this number from the previously calculated value of the angle between the direction of Mecca and the timepiece axis 12 o'clock—6 o'clock.

The result of this subtraction corresponds to the number of steps to be taken by motor 20 to orient the direction hand toward Mecca. Electronic control means 22 control the moving forward of motor 20 by sending to driving circuit 16 a number of pulses corresponding to the number of steps to be made by the motor. The pulses supplied by electronic means 22 to move forward motor 20 increment simultaneously direction hand position counter 38. In this way, the contents of counter 38 always correspond to the position of the direction hand on the dial.

What I claim is:

1. A timepiece comprising a time base, display means for displaying a local time, and time setting means for setting said local time, said display means also being for displaying additional data which are a function of a place where the timepiece is located on the earth's surface, said timepiece further comprising:

means for determining the value of the time difference between the local time and the time of a reference time zone;

means for converting said time difference value into an approximate value of the local longitude;

means for determining the inclination of the earth's magnetic field in relation to the horizontal;

means for converting the determined inclination of the earth's magnetic field into an approximate value of the local latitude;

a time difference counter for keeping account of all changes in said displayed time that are produced by said time setting means when there is a change of time zone, the contents of said counter corresponding to said time difference value;

calculating means for calculating, as a function of said place where the timepiece is located, the azimuth of a preselected place on the earth's surface; and measuring means for determining the direction of magnetic north;

wherein said calculating means determines, as a function of said azimuth and said direction of the magnetic north, the direction of said preselected place, said additional displayed data being said direction of the preselected place, and said direction being displayed with the aid of a pointer.

* * * * *